United States Patent [19]

Torii et al.

[11] 3,971,029

[45] July 20, 1976

[54] WINDOW ANTENNA DEVICE FOR USE IN MOTOR VEHICLE

[75] Inventors: Taketsugu Torii, Kasugai; Minoru Nishio, Okazaki, both of Japan

[73] Assignee: Toyota Jidosha Kogyo Kabushiki Kaisha, Japan

[22] Filed: Oct. 3, 1974

[21] Appl. No.: 511,935

[30] Foreign Application Priority Data

Jan. 14, 1974 Japan ..... 49-7433[U]

[52] U.S. Cl. ..... 343/704; 219/203; 343/713

[51] Int. Cl.[2] ..... H01Q 1/32; H01Q 1/02

[58] Field of Search ..... 343/711, 713, 704; 219/203

[56] References Cited

UNITED STATES PATENTS

| | | | |
|---|---|---|---|
| 3,484,584 | 12/1969 | Shaw, Jr. | 219/203 X |
| 3,728,732 | 4/1973 | Igarashi | 343/713 |
| 3,771,159 | 11/1973 | Kawaguchi et al. | 343/713 X |
| 3,845,489 | 10/1974 | Sauer et al. | 343/713 |

*Primary Examiner*—Paul L. Gensler
*Attorney, Agent, or Firm*—Lane, Aitken, Dunner & Ziems

[57] ABSTRACT

A radio antenna device having an antenna wire and a gain increasing antenna secured to the rear window of motor vehicle in the same manner as is used for a moisture preventive heat wire. An antenna wire is secured to the rear window of a motor vehicle in an attempt to reduce such disturbance in receiving a radio wave, which accrues from an engine, electric generator and electric motor mounted on a motor vehicle or for the purpose of eliminating a space for mounting an antenna, while a gain increasing antenna is provided for compensating for the reduction in radio-wave receiving level, which is caused by shielding action of a moisture preventive heat wire which is secured to the rear window or a portion of a vehicle body, which extends along the periphery of the rear window.

5 Claims, 2 Drawing Figures

WINDOW ANTENNA DEVICE FOR USE IN MOTOR VEHICLE

SUMMARY OF THE INVENTION:

This invention relates to a radio antenna device for use in a motor vehicle, and more particularly to a radio antenna provided on the rear window of a motor vehicle.

Hitherto, an antenna of a pole type has found its wide use in a motor vehicle, suffering from a disadvantage of a need to prepare a space for allowing the extension of an antenna, resulting in inconvenience in its practical use. To overcome such a disadvantage, there has been proposed an attempt to provide an antenna in the front portion of a motor vehicle. However, this has been proved to be not a right solution to this problem, because of the electrical noise being emitted from an engine, electric generator and other electric circuits.

This invention is directed to avoiding the aforesaid disadvantages by providing a radio antenna device for use in a motor vehicle, which dispenses with an antenna space and is less in noise and substantially high in gain.

According to the present invention, there is provided a radio antenna device, comprising an antenna wire rigidly secured to the rear window of a motor vehicle in the similar manner as is used for a moisture preventive heat wire, coupled with a gain increasing antenna provided in the similar manner.

This minimizes noise in receiving radio waves, because a single antenna wire is secured to the rear window of a vehicle, which wire is averted from an engine (front portion), a generator (front portion) and other electric circuits (more in the front portion and less in the rear). However, the level of receiving radio waves, of the antenna device is somewhat lowered, because the antenna is electrically shielded by a moisture preventive heat wire or such a body portion of a vehicle, which extends along the periphery of the rear window. To overcome this shortcoming, the present invention contemplates to arrange the gain increasing antenna in parallel with the antenna, whereby the radio wave is induced and a high gain is imparted to a radio receiver.

Figure 1:
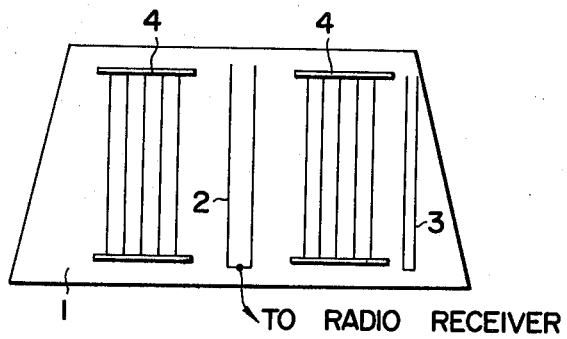
FIG. 1 is a plan view of one embodiment of an antenna device according to the present invention.

DETAILED DESCRIPTION OF THE PREFERRED EMBODIMENTS:

Referring now to FIG. 1, there is shown an embodiment wherein a moisture preventive heat wire 4 and an antenna wire 2 plus a gain increasing antenna 3 are provided vertically on a rear window 1. The moisture preventive heat wire 4, antenna wire 2 and gain increasing antenna 3 are formed on the rear window 1 by using coating and baking techniques. Alternatively, the antenna wire 2 and gain increasing antenna 3 may be prepared by using metal evaporating or laminating technique, as is used in preparing the moisture preventive heat wire 4. The gain increasing antenna 3 functions to increase a gain in receiving radio waves by the antenna wire 2. As has been described earlier, in case the antenna wire is secured to the rear window, the gain of antenna wire in receiving radio waves will be lowered due to electrical shielding by the body portion of a vehicle, which extends along the periphery of the rear window 1. However, a high gain may be achieved by arranging the gain increasing antenna in parallel with the antenna wire 2. The gain increasing antenna is in a condition where it floats electrically, i.e., where it is connected to no substance. Meanwhile, it is not clear why the provision of a gain increasing antenna brings about a high gain for the antenna wire 2 in receiving radio waves. The desirable condition of the electric field distribution in the vicinity of the antenna 2 may be the cause for this. The inventors have measured gains in the case of the use of the gain increasing antenna as well as in the absence thereof for the rear windows of the same configuration. The results are shown in the table below, indicating high gain in receiving radio wave:

| | In the absence of gain increasing antenna | In the case of the use of gain increasing antenna |
|---|---|---|
| Gain (dB) | 38.5 | 43 |

In either case, there results a lowered noise level, since the antenna wire is provided on the rear window. A similar result may be obtained, if wire 3 is used as the antenna wire and wire 2 is used as the gain increasing antenna.

Figure 2:
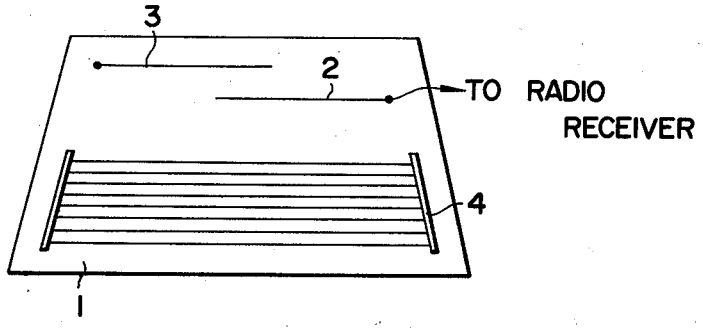
FIG. 2 is a plan view of another antenna device embodying the present invention.

Referring to FIG. 2 which shows another embodiment of the present invention, an antenna wire 2, gain increasing antenna 3 and moisture preventive heat wire 4 are arranged in the horizontal direction. Those wires may be buried in or printed on the rear window glass. Alternatively, wire 2 is used as a gain increasing antenna, while wire 3 is used as an antenna.

As is apparent from the foregoing description, due to the arrangement of the antenna device according to the present invention, an antenna wire and a gain increasing antenna are provided on the rear window of a motor vehicle, so that a space for mounting an antenna is not required, providing less noise and high gain.

What is claimed is:

1. A window antenna device for use in a motor vehicle, comprising an antenna wire secured to the rear window of a motor vehicle in the same manner as is used for a moisture preventive heater wire, a moisture preventive heater wire, being provided on the rear window and a gain increasing antenna wire which is permanently electrically isolated on the window so as to be electrically floating extending substantially in parallel with said antenna wire on said rear window.

2. A window antenna device for use in a motor vehicle as set forth in claim 1, wherein said antenna wire and said gain increasing antenna wire are provided on the rear window of said vehicle in parallel with said moisture preventive heater wire.

3. A window antenna device, comprising an elongated antenna wire fixed to a window, coupling means for electrically connecting said antenna wire to a receiver remote from said window, and auxiliary means for increasing the gain of said antenna wire including an electrically isolated elongated wire spaced from said antenna wire and fixed to said window substantially in parallel with said antenna wire, and isolated wire being electrically floating.

4. A window antenna device as set forth in claim 3, further comprising conductor means fixed to said window for heating said window to prevent accumulation of moisture thereon.

5. A window antenna device as set forth in claim 4, wherein said conductor means includes a heater wire substantially parallel to said antenna wire.

* * * * *